US011517999B2

(12) United States Patent
Nakamura

(10) Patent No.: US 11,517,999 B2
(45) Date of Patent: Dec. 6, 2022

(54) POLISHING APPARATUS AND POLISHING METHOD

(71) Applicant: EBARA CORPORATION, Tokyo (JP)

(72) Inventor: Akira Nakamura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 150 days.

(21) Appl. No.: 16/779,665

(22) Filed: Feb. 3, 2020

(65) Prior Publication Data

US 2020/0262027 A1 Aug. 20, 2020

(30) Foreign Application Priority Data

Feb. 18, 2019 (JP) ..... JP2019-026255

(51) Int. Cl.

| | |
|---|---|
| ***B24B 49/16*** | (2006.01) |
| ***B24B 49/10*** | (2006.01) |
| ***B24B 37/013*** | (2012.01) |
| ***B24B 37/30*** | (2012.01) |
| ***B24B 37/20*** | (2012.01) |

(52) U.S. Cl.

CPC ..... *B24B 49/16* (2013.01); *B24B 37/013* (2013.01); *B24B 49/10* (2013.01); *B24B 37/20* (2013.01); *B24B 37/30* (2013.01)

(58) Field of Classification Search

CPC ..... B24B 49/10; B24B 49/16; B24B 7/228; B24B 37/005; B24B 37/013; B24B 37/04; B24B 37/042; B24B 37/10; B24B 37/105; B24B 37/107

See application file for complete search history.

(56) References Cited

U.S. PATENT DOCUMENTS

| | | | | |
|---|---|---|---|---|
| 5,275,055 | A | 1/1994 | Zook et al. | |
| 6,046,111 | A * | 4/2000 | Robinson | B24B 37/013 438/693 |
| 6,645,050 | B1 * | 11/2003 | Butterfield | B24B 37/32 451/388 |
| 2001/0006870 | A1 * | 7/2001 | Moore | B24B 53/12 451/283 |
| 2002/0037681 | A1 | 3/2002 | Gitis et al. | |

(Continued)

FOREIGN PATENT DOCUMENTS

| | | |
|---|---|---|
| JP | S5920106 | 2/1984 |
| JP | H06320416 | 11/1994 |

(Continued)

*Primary Examiner* — Joel D Crandall

(74) *Attorney, Agent, or Firm* — JCIPRNET

(57) ABSTRACT

A novel polishing apparatus which determines a polishing end point of a substrate on the basis of a strain of a constituent element of the polishing apparatus caused by friction between a substrate such as a wafer and a polishing pad. The polishing apparatus includes a rotatable polishing table which supports a polishing pad, a polishing head which presses the substrate against the polishing pad, a rotating shaft connected to the polishing head, a support structure which rotatably supports the rotating shaft, a strain measuring instrument which measures a strain of the support structure, and an end point detector which determines a polishing end point of the substrate on the basis of a change in the strain. The strain measuring instrument includes at least one strain sensor fixed to the support structure.

11 Claims, 4 Drawing Sheets

(56) References Cited

U.S. PATENT DOCUMENTS

| | | | | |
|---|---|---|---|---|
| 2003/0109194 | A1* | 6/2003 | Wang | B24B 49/16 451/5 |
| 2007/0087662 | A1* | 4/2007 | Benvegnu | B24B 49/16 700/121 |
| 2013/0122788 | A1* | 5/2013 | Chang | B24B 37/013 451/340 |
| 2013/0167614 | A1 | 7/2013 | Miller et al. | |
| 2017/0153151 | A1* | 6/2017 | Cuttino | G01G 3/08 |
| 2018/0093360 | A1 | 4/2018 | Shinozaki et al. | |
| 2019/0131150 | A1* | 5/2019 | Suzuki | H01L 21/67219 |

FOREIGN PATENT DOCUMENTS

| | | |
|---|---|---|
| JP | 2004245822 | 9/2004 |
| JP | 2007510164 | 4/2007 |
| JP | 2018058197 | 4/2018 |
| WO | 2013074707 | 5/2013 |

* cited by examiner

POLISHING APPARATUS AND POLISHING METHOD

CROSS-REFERENCE TO RELATED APPLICATION

This application claims the priority benefit of Japan application serial no. 2019-026255, filed on Feb. 18, 2019. The entirety of the above-mentioned patent application is hereby incorporated by reference herein and made a part of this specification.

BACKGROUND

Technical Field

The disclosure relates to a polishing apparatus and a polishing method for polishing a substrate such as a wafer, and more particularly to a technique for detecting a polishing end point of a substrate.

Description of Related Art

Chemical mechanical polishing (CMP) is a technique for polishing a substrate such as a wafer in the presence of a slurry. More specifically, a surface of the wafer is brought into sliding contact with a polishing pad in the presence of the slurry by pressing the wafer against the polishing pad while supplying the slurry to the polishing pad on a rotating polishing table. The surface of the wafer is polished by a chemical action of the slurry and a mechanical action of abrasive grains contained in the slurry.

A polishing end point of the wafer is determined on the basis of a change in a surface state of the wafer. In one example, the polishing end point is a point in time when a film forming the surface of the wafer is removed and an underlying layer is exposed. In order to determine such a polishing end point, there is a technique which monitors a change in a motor current supplied to a table motor for rotating a polishing table. When the surface state of the wafer changes, friction between the wafer and the polishing pad changes, and as a result, the motor current changes. Therefore, a changing point of the motor current can be set as the polishing end point.

PATENT DOCUMENTS

[Patent Document 1] Published Japanese Translation No. 2007-510164 of the PCT International Publication Recently, instead of the above-described method of monitoring the motor current, a method of determining the polishing end point on the basis of a strain of the polishing table has been proposed (for example, refer to Patent Document 1).

SUMMARY

The disclosure provides a novel polishing apparatus and a novel polishing method for determining a polishing end point of a substrate on the basis of a strain of a constituent element of the polishing apparatus caused by friction between a substrate such as a wafer and a polishing pad.

According to an aspect, there is provided a polishing apparatus which polishes a substrate, including a rotatable polishing table which supports a polishing pad, a polishing head which presses the substrate against the polishing pad, a rotating shaft connected to the polishing head, a support structure which rotatably supports the rotating shaft, a strain measuring instrument which measures a strain of the support structure, and an end point detector which determines a polishing end point of the substrate on the basis of a change in the strain, wherein the strain measuring instrument includes at least one strain sensor fixed to the support structure.

In one aspect, the strain measuring instrument may have two measurement modes including a low resolution measurement mode which measures the strain at a first resolution, and a high resolution measurement mode which measures the strain at a second resolution higher than the first resolution.

In one aspect, the low resolution measurement mode may be a low gain mode which converts a first range of the strain into a predetermined measurement output range, and the high resolution measurement mode may be a high gain mode which converts a second range of the strain narrower than the first range into the measurement output range.

In one aspect, the strain measuring instrument may include a signal converter which converts the first range into the measurement output range and converts the second range into the measurement output range, and the strain sensor may be connected to the signal converter.

In one aspect, the strain measuring instrument may include a first strain measuring instrument which is operated in the low resolution measurement mode, and a second strain measuring instrument which is operated in the high resolution measurement mode, the first strain measuring instrument may include a first strain sensor fixed to the support structure, and the second strain measuring instrument may include a second strain sensor fixed to the support structure.

In one aspect, the end point detector may be constituted to issue a command to the strain measuring instrument during the polishing of the substrate and to switch the measurement mode of the strain measuring instrument from the low resolution measurement mode to the high resolution measurement mode.

In one aspect, there is provided a polishing method which polishes a substrate, including rotating a polishing table which supports a polishing pad, polishing the substrate by pressing the substrate against the polishing pad with a polishing head connected to a rotating shaft, measuring a strain of a support structure which rotatably supports the rotating shaft with a strain measuring instrument during polishing of the substrate, and determining a polishing end point of the substrate on the basis of a change in the strain, wherein the strain measuring instrument includes at least one strain sensor fixed to the support structure.

In one aspect, the polishing method may further include switching a measurement mode of the strain measuring instrument from a low resolution measurement mode to a high resolution measurement mode during the polishing of the substrate, the low resolution measurement mode may be a measurement mode which measures the strain at a first resolution, the high resolution measurement mode may be a measurement mode which measures the strain at a second resolution higher than the first resolution, and the determining of the polishing end point of the substrate on the basis of the change in the strain may be determining of the polishing end point of the substrate on the basis of the change in the strain measured in the high resolution measurement mode.

In one aspect, after the strain reaches a peak value during the polishing of the substrate, the measurement mode of the strain measuring instrument may be switched from the low resolution measurement mode to the high resolution measurement mode.

The polishing method may further include adjusting an output value of the strain measuring instrument to a preset value after switching the measurement mode of the strain measuring instrument from the low resolution measurement mode to the high resolution measurement mode.

In one aspect, the low resolution measurement mode may be a low gain mode which converts a first range of the strain into a predetermined measurement output range, and the high resolution measurement mode may be a high gain mode which converts a second range of the strain narrower than the first range into the measurement output range.

In one aspect, the polishing method may further include calibrating the strain measuring instrument before polishing the substrate.

In one aspect, the calibrating of the strain measuring instrument may include determining a first output value of the strain measuring instrument when a first force is applied to the support structure, determining a second output value of the strain measuring instrument when a second force different from the first force is applied to the support structure, and adjusting the first output value and the second output value to a first reference value and a second reference value, respectively.

A frictional force generated between the substrate and the polishing pad is transmitted to the support structure via the polishing head and the rotating shaft. The strain of the support structure during the polishing of the substrate varies according to the frictional force generated between the substrate and the polishing pad. When a film forming a surface of the substrate is removed and an underlying layer is exposed, the frictional force changes. Thus, the end point detector can determine the polishing end point of the substrate on the basis of a change in the strain of the support structure.

DESCRIPTION OF THE EMBODIMENTS

Hereinafter, an embodiment of the disclosure will be described with reference to the drawings.

Figure 1:
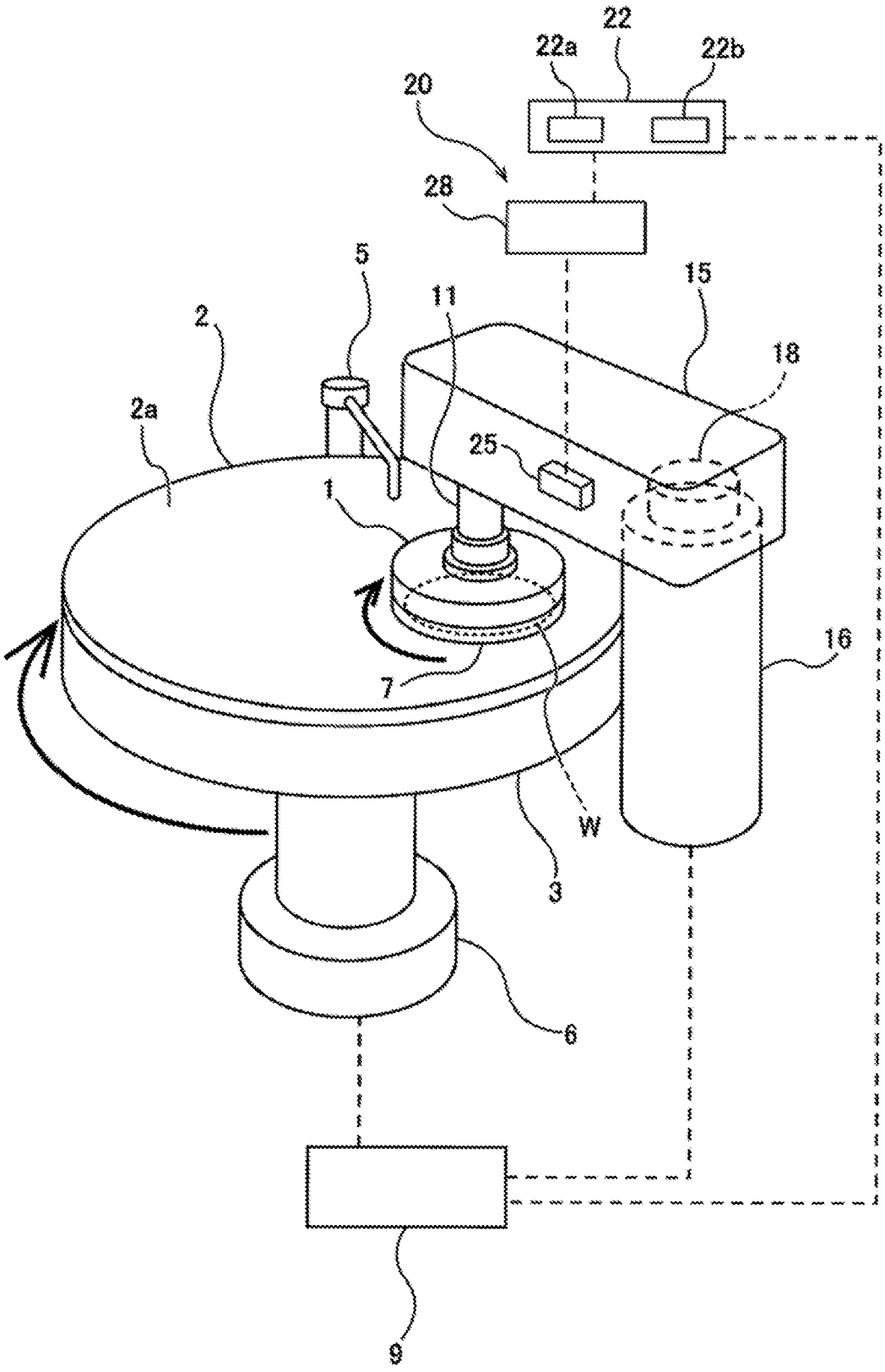
FIG. 1 is a schematic view showing an embodiment of a polishing apparatus.

FIG. 1 is a schematic view showing an embodiment of a polishing apparatus. As shown in FIG. 1, the polishing apparatus includes a polishing table 3 which supports a polishing pad 2, a polishing head 1 which presses a wafer W which is an example of a substrate against the polishing pad 2, a table motor 6 which rotates the polishing table 3, a rotating shaft 11 which is connected to the polishing head 1, a support structure 15 which rotatably supports the rotating shaft 11, and a slurry supply nozzle 5 which supplies a slurry onto the polishing pad 2. A surface of the polishing pad 2 constitutes a polishing surface 2*a* which polishes the wafer W.

The polishing table 3 is connected to a table motor 6 and is configured to rotate the polishing table 3 and the polishing pad 2 integrally. The polishing head 1 is fixed to an end portion of the rotating shaft 11, and the rotating shaft 11 is rotatably supported by the support structure 15. The rotating shaft 11 is connected to a rotating device (not shown) disposed inside the support structure 15, and the rotating shaft 11 and the polishing head 1 are rotated by the rotating device. The support structure 15 is supported by a turning motor 18 fixed to a support shaft 16. When the turning motor 18 is operated, the support structure 15 and the polishing head 1 turn about the support shaft 16.

The polishing head 1 includes a retainer ring 7 which surrounds the wafer W. The retainer ring 7 is provided to prevent the wafer W from being separated from the polishing head 1 during polishing of the wafer W. During the polishing of the wafer W, the retainer ring 7 is pressed against the polishing pad 2 outside the wafer W.

The wafer W is polished as follows. The slurry is supplied from the slurry supply nozzle 5 to the polishing surface 2*a* of the polishing pad 2 on the polishing table 3 while the polishing table 3 and the polishing head 1 rotate in a direction shown by an arrow in FIG. 1. The wafer W is pressed against the polishing surface 2*a* of the polishing pad 2 in a state in which the slurry is present between the polishing pad 2 and the wafer W while rotated by the polishing head 1. A surface of the wafer W is polished by a chemical action of the slurry and a mechanical action of abrasive grains contained in the slurry.

The polishing apparatus further includes an operation control unit 9 which controls operations of the polishing head 1, the polishing table 3, and the slurry supply nozzle 5. The operation control unit 9 is constituted with at least one computer.

The polishing apparatus further includes a strain measuring instrument 20 which measures a strain of the support structure 15, and an end point detector 22 which determines a polishing end point of the wafer W on the basis of a change in the strain of the support structure 15. The strain measuring instrument 20 includes a strain sensor 25 which is fixed to the support structure 15, and a signal converter 28 which is electrically connected to the strain sensor 25. In the embodiment, the strain sensor 25 is fixed to a side surface of the support structure 15. Two strain sensors 25 may be fixed to both side surfaces of the support structure 15.

The end point detector 22 is constituted with at least one computer. The end point detector 22 includes a storage device 22*a* in which a program is stored, and an arithmetic device 22*b* which performs an arithmetic operation according to the program. The arithmetic device 22*b* includes a central processing unit (CPU), a graphics processing unit (GPU), or the like. The storage device 22*a* includes a main storage device (for example, a random access memory) which can be accessed by the arithmetic device 22*b*, and an auxiliary storage device (for example, a hard disk drive or a solid state drive) which stores data and programs.

A position of the strain sensor 25 on the support structure 15 is not particularly limited as long as the strain measuring instrument 20 can correctly measure the strain of the support structure 15. In one embodiment, one or more strain sensors 25 may be fixed to an upper surface and/or a lower surface of support structure 15.

The strain sensor 25 used in the embodiment is a piezoelectric sensor equipped with a crystal. When the crystal is deformed due to the strain of the support structure 15, the crystal emits electric charges due to a piezoelectric effect. The electric charges are sent to the signal converter 28 and converted into a voltage. In one example, the signal converter 28 is constituted with a charge amplifier. A value of the converted voltage is proportional to a magnitude of the strain. The signal converter 28 outputs the value of the voltage as an output value which indicates the magnitude of the strain. The output value (the voltage value) of the signal converter 28 indicates the magnitude of the strain of the support structure 15 and changes according to the magnitude of the strain of the support structure 15.

However, the strain measuring instrument 20 is not particularly limited as long as it can directly or indirectly measure the strain of the support structure 15. For example, the strain measuring instrument 20 may include a combination of a strain gauge and an amplifier, or a piezoelectric element using a material other than the crystal.

In the specification, measuring the strain means not only measuring the magnitude of the strain itself, but also determining a physical quantity or index value which changes according to the magnitude of the strain. The output value (the voltage value) of the signal converter 28 which changes according to the magnitude of the strain is an example of a measured value of the strain.

Figure 2:
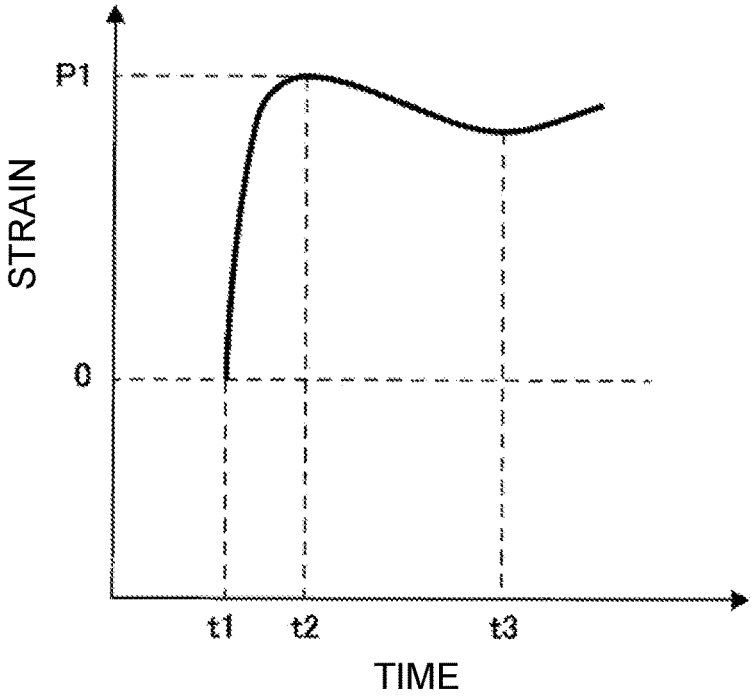
FIG. 2 is a graph showing a change in a strain of a support structure from a point in time when a wafer is brought into contact with a polishing pad.

FIG. 2 is a graph showing a change in the strain of the support structure 15 from a point in time when the wafer W is brought into contact with the polishing pad 2. In FIG. 2, a vertical axis represents the strain of the support structure 15, and a horizontal axis represents time. When the wafer W is brought into contact with the polishing pad 2 at a time point t1, the strain of the support structure 15 rapidly increases. When the wafer W is brought into contact with the polishing pad 2, the retainer ring 7 also comes into contact with the polishing pad 2. Therefore, the strain of the support structure 15 is caused by a resultant force of a frictional force generated between the wafer W and the polishing pad 2 and a frictional force generated between the retainer ring 7 and the polishing pad 2.

After the polishing of the wafer W starts, the strain of the support structure 15 continues to increase until the polishing of the wafer W is stabilized. When the polishing of the wafer W is stabilized, the strain reaches a peak value P1 (a time point t2), and then the strain gradually decreases as the polishing of the wafer W is progressed. When a film constituting the surface of the wafer W is removed and an underlying layer is exposed, a frictional force between the wafer W and the polishing pad 2 increases. Due to the increase in the frictional force, the strain of the support structure 15 starts to increase (a time point t3).

The end point detector 22 is electrically connected to the strain measuring instrument 20, and an output value of the strain measuring instrument 20 is sent to the end point detector 22. The end point detector 22 determines the polishing end point of the wafer W on the basis of a change in the strain of the support structure 15. More specifically, the end point detector 22 determines the polishing end point of the wafer W which is a point in time when a rate of change in the strain (that is, an amount of change in the strain per unit time) exceeds a threshold value.

Depending on a combination of a material of the film constituting the surface of the wafer W and a material of the underlying layer present below the film, the strain of the support structure 15 may be greatly reduced when the underlying layer is exposed by polishing the wafer W. In such a case, the end point detector 22 determines the polishing end point of the wafer W which is the point in time when the rate of change in the strain falls below the threshold value.

The frictional force generated between the wafer W and the polishing pad 2 is transmitted to the support structure 15 via the polishing head 1 and the rotating shaft 11. Although the frictional force generated between the retainer ring 7 and the polishing pad 2 is also applied to the support structure 15, the frictional force generated between the retainer ring 7 and the polishing pad 2 is substantially constant during the polishing of the wafer W. Therefore, the strain of the support structure 15 during the polishing of the wafer W changes according to the frictional force generated between the wafer W and the polishing pad 2. When the film constituting the surface of the wafer W is removed and the underlying layer is exposed, the frictional force changes. Thus, the end point detector 22 can determine the end point of the wafer W on the basis of the change in the strain of the support structure 15.

The strain of the support structure 15 is caused by the resultant force of the frictional force generated between the wafer W and the polishing pad 2 and the frictional force generated between the retainer ring 7 and the polishing pad 2. A peak value P1 shown in the graph of FIG. 2 is a maximum value of the magnitude of the strain of the support structure 15 caused by the two frictional forces. The change in the strain according to the polishing of the wafer W is smaller than the peak value P1.

In order to accurately determine the polishing end point of the wafer W, it is necessary to detect the change in the strain according to the polishing of the wafer W with high sensitivity. One possible solution is to increase a measurement resolution of the strain measuring instrument 20. However, when the measurement resolution is increased, the peak value P1 may not be within an effective measurement range of the strain measuring instrument 20.

Therefore, in one embodiment, the strain measuring instrument 20 is constituted to switch a measurement mode from a low resolution measurement mode to a high resolution measurement mode during the polishing of the wafer W. The strain measuring instrument 20 has two measurement modes including a low resolution measurement mode which measures the strain of the support structure 15 at a first resolution, and a high resolution measurement mode which measures the strain of the support structure 15 at a second resolution higher than the first resolution.

In the embodiment, the low resolution measurement mode is a low gain mode in which a first range of the strain is converted into a predetermined measurement output range, and the high resolution measurement mode is a high gain mode in which a second range of the strain which is narrower than the first range is converted to the measurement output range. The signal converter 28 is constituted to convert the first range of the strain into a predetermined measurement output range during the low resolution measurement mode and to convert the second range of strain into the measurement output range during the high resolution measurement mode. For example, when the first range of the strain is set to 0 to 1000, the second range of the strain is set to 0 to 10, and the measurement output range is set to 0 V to 10 V, the first range of the strain of 0 to 1000 corresponds to the measurement output range of 0 V to 10 V in the low resolution measurement mode. On the other hand, in the high resolution measurement mode, the second range of the strain of 0 to 10 corresponds to the measurement output range of 0 V to 10 V. In the high resolution measurement mode, since the change in the strain per 1 V is smaller than that in the low resolution measurement mode, the strain measuring instrument 20 in the high resolution measurement mode can measure the strain of the support structure 15 more finely.

The strain measuring instrument 20 switches the measurement mode from the low resolution measurement mode to the high resolution measurement mode during the polishing of the wafer W. A timing at which the measurement mode is switched from the low resolution measurement mode to the high resolution measurement mode is when the polishing of the wafer W is stable and is preferably an initial stage of polishing the wafer W. Therefore, in the embodiment, the strain measuring instrument 20 switches the measurement mode from the low resolution measurement mode to the high resolution measurement mode after the strain reaches the peak value P1.

Figure 3:
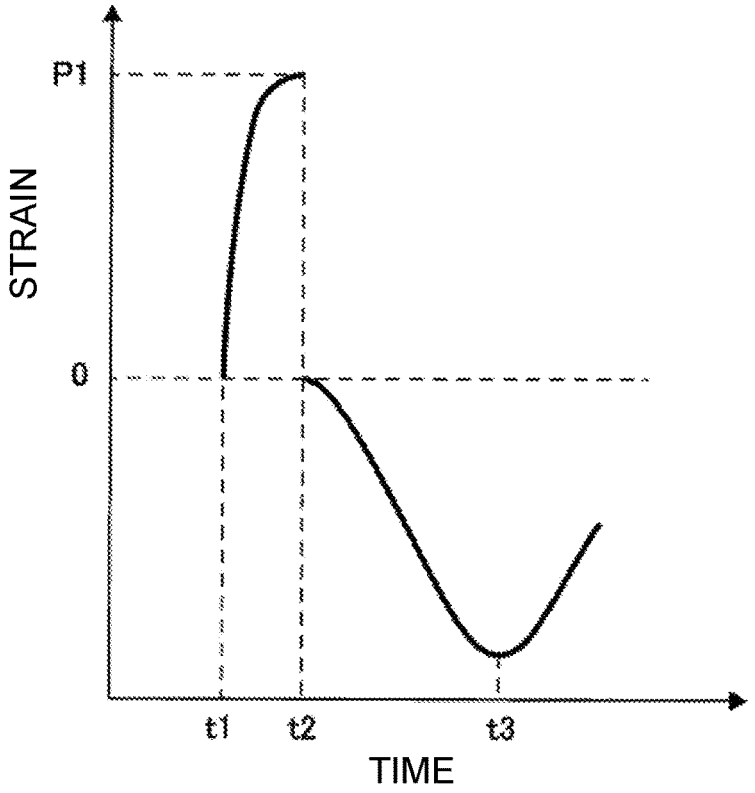
FIG. 3 is a graph showing a change in the strain when a measurement mode of a strain measuring instrument is switched from a low resolution measurement mode to a high resolution measurement mode after the strain reaches a peak value.

FIG. 3 is a graph showing a change in the strain when the measurement mode of the strain measuring instrument 20 is switched from the low resolution measurement mode to the high resolution measurement mode after the strain reaches the peak value P1. The end point detector 22 issues a command to the strain measuring instrument 20 so that the strain measuring instrument 20 measures the strain of the support structure 15 in the low resolution measurement mode at the initial stage of the polishing of the wafer W (from a time point t1 to a time point t2). The end point detector 22 determines that the strain has reached the peak value P1 on the basis of the output value of the strain measuring instrument 20, then issues a command to the strain measuring instrument 20 and switches the measurement mode of the strain measuring instrument 20 from the low resolution measurement mode to the high resolution measurement mode (the time point t2). The strain measuring instrument 20 measures the strain of the support structure 15 in the high resolution measurement mode. Then, the end point detector 22 determines the polishing end point of the wafer W on the basis of the change in the strain measured in the high resolution measurement mode (a time point t3).

As shown in FIG. 3, in the embodiment, the strain measuring instrument 20 is constituted to perform an output value reset for adjusting the output value to a preset value when the measurement mode of the strain measuring instrument 20 is switched from the low resolution measurement mode to the high resolution measurement mode. In the embodiment, the preset value is 0. Therefore, in the high resolution measurement mode, the output value of the strain measuring instrument 20 starts from 0. In one embodiment, the preset value used for resetting the output value may be a numerical value other than 0.

The reset of the output value of the strain measuring instrument 20 may be performed whenever one wafer is polished or may be performed whenever a plurality of wafers is polished. Alternatively, the reset of the output value of the strain measuring instrument 20 may be performed using a dummy wafer (a dummy substrate). Examples of the dummy wafer include a bare silicon wafer having no film formed thereon, a bracket wafer having a uniform film formed on a surface thereof, and the like. For example, when it is assumed that the output value of the strain measuring instrument 20 decreases monotonously, the strain measuring instrument 20 can measure the strain of the support structure 15 in a larger range by adjusting the output value of the strain measuring instrument 20 to a maximum value input to the signal converter 28.

In the above-described embodiment, the measurement mode of one strain measuring instrument 20 is switched from the low resolution measurement mode to the high resolution measurement mode, but the disclosure is not limited to the embodiment. In one embodiment, as shown in FIG. 4, the strain measuring instrument 20 includes a first strain measuring instrument 20A which is operated in the low resolution measurement mode, and a second strain measuring instrument 20B which is operated in the high resolution measurement mode.

The first strain measuring instrument 20A includes a first strain sensor 25A fixed to the support structure 15, and a first signal converter 28A connected to the first strain sensor 25A. The second strain measuring instrument 20B includes a second strain sensor 25B fixed to the support structure 15, and a second signal converter 28B connected to the second strain sensor 25B. The end point detector 22 is connected to both the first strain measuring instrument 20A and the second strain measuring instrument 20B, and an output value of the first strain measuring instrument 20A and an output value of the second strain measuring instrument 20B are sent to the end point detector 22.

The end point detector 22 issues a command to the first strain measuring instrument 20A and the second strain measuring instrument 20B during the polishing of the wafer W and switches the measurement of the strain of the support structure 15 from the measurement using the first strain measuring instrument 20A to the measurement using the second strain measuring instrument 20B. More specifically, the end point detector 22 issues a command to the first strain measuring instrument 20A so that the first strain measuring instrument 20A measures the strain of the support structure 15 in the low resolution measurement mode at the initial stage of the polishing the wafer W. The end point detector 22 determines that the strain has reached the peak value P1 on the basis of the output value of the first strain measuring instrument 20A, then issues a command to the second strain measuring instrument 20B and causes the second strain measuring instrument 20B to measure the strain of the support structure 15 in the high resolution measurement mode. Then, the end point detector 22 determines the polishing end point of the wafer W on the basis of the change in the strain measured in the high resolution measurement mode.

Figure 4:
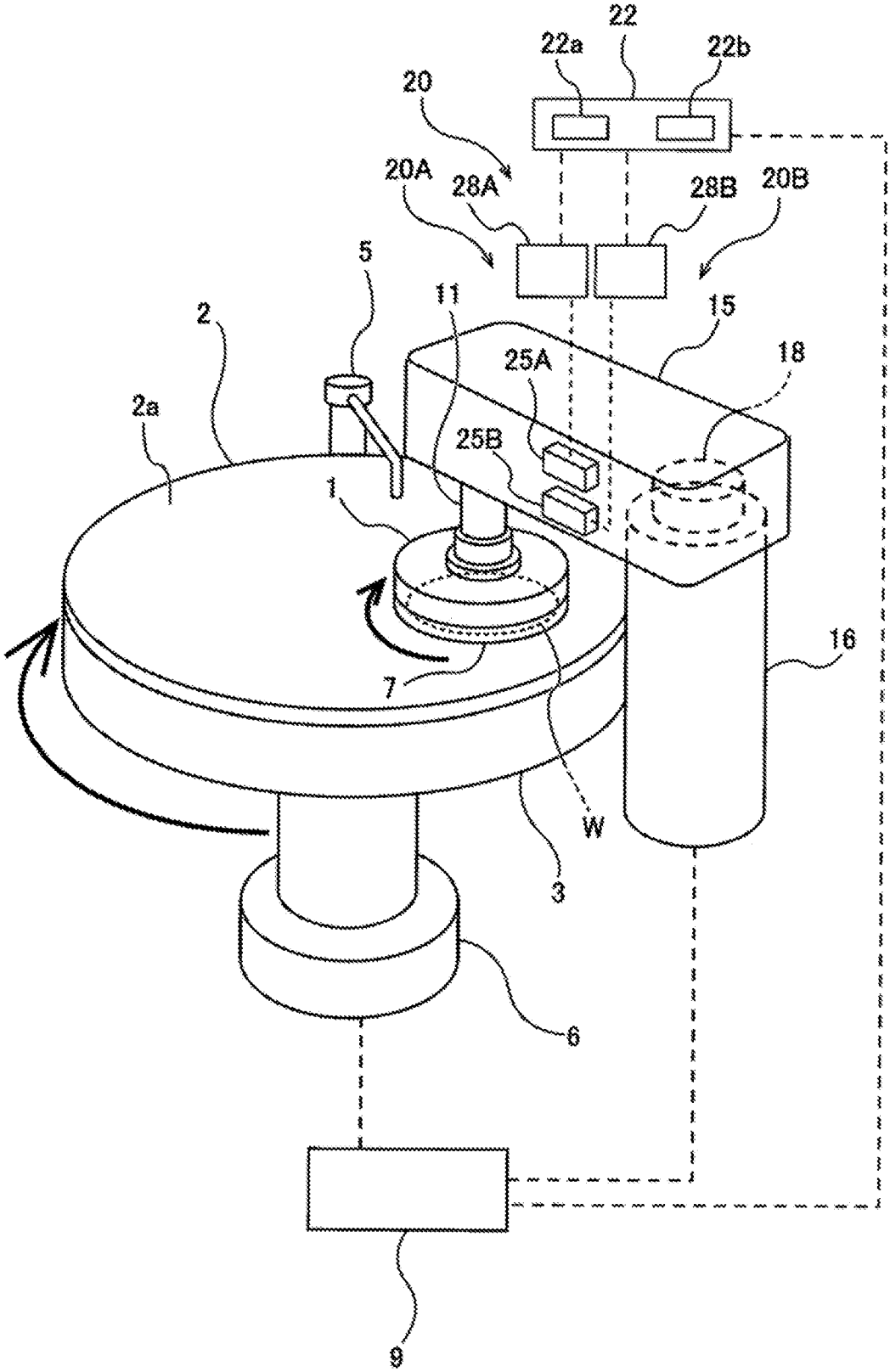
FIG. 4 is a schematic diagram showing an embodiment of a polishing apparatus including a first strain measuring instrument which is operated in the low resolution measurement mode and a second strain measuring instrument which is operated in the high resolution measurement mode.

Also in the embodiment shown in FIG. 4, as in the graph shown in FIG. 3, the measurement mode of the strain during the polishing of the wafer W is switched from the low resolution measurement mode to the high resolution measurement mode. Therefore, the end point detector 22 can accurately determine the polishing end point of the wafer W.

The magnitude of the strain of the support structure 15 measured by the strain measuring instrument 20 may vary according to a strength of the support structure 15 and a mounting position of the strain sensor 25 in addition to the frictional force. In other words, even when the frictional force generated between the wafer W and the polishing pad 2 is the same, the output value of the strain measuring instrument 20 can change according to the strength of the support structure 15 and the mounting position of the strain sensor 25.

Therefore, in one embodiment, as described below, the strain measuring instrument 20 is calibrated by associating the force applied to the support structure 15 with the output value of the strain measuring instrument 20.

Figure 5:
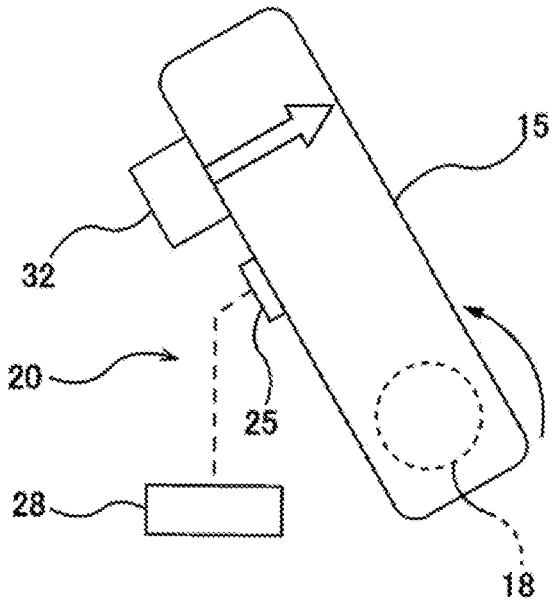
FIG. 5 is a top view of the support structure when the strain measuring instrument is calibrated.

FIG. 5 is a top view of the support structure 15 when the strain measuring instrument 20 is being calibrated. A load measuring instrument 32 such as a load cell is installed beside the support structure 15. The load measuring instrument 32 is fixed to a stationary member (not shown). When a first torque current is supplied to the turning motor 18, the support structure 15 rotates around the turning motor 18 and is pressed against the load measuring instrument 32. At this time, the support structure 15 receives a first force (a reaction force) from the load measuring instrument 32 and is distorted. The load measuring instrument 32 measures the first force applied to the support structure 15, and at the same time, the strain measuring instrument 20 measures the strain of the support structure 15.

Next, when a second torque current different from the first torque current is supplied to the turning motor 18, the support structure 15 is similarly pressed against the load measuring instrument 32. At this time, the support structure 15 receives the second force (a reaction force) different from the first force from the load measuring instrument 32 and is distorted. The load measuring instrument 32 measures the second force applied to the support structure 15, and at the same time, the strain measuring instrument 20 measures the strain of the support structure 15.

The calibration of the strain measuring instrument 20 includes a step of determining a first output value of the strain measuring instrument 20 when the first force is applied to the support structure 15, and a step of determining a second output value of the strain measuring instrument 20 when the second force different from the first force is applied to the support structure 15, and a step of adjusting the first output value and the second output value to a first reference value and a second reference value, respectively. The first reference value and the second reference value are predetermined values.

Figure 6:
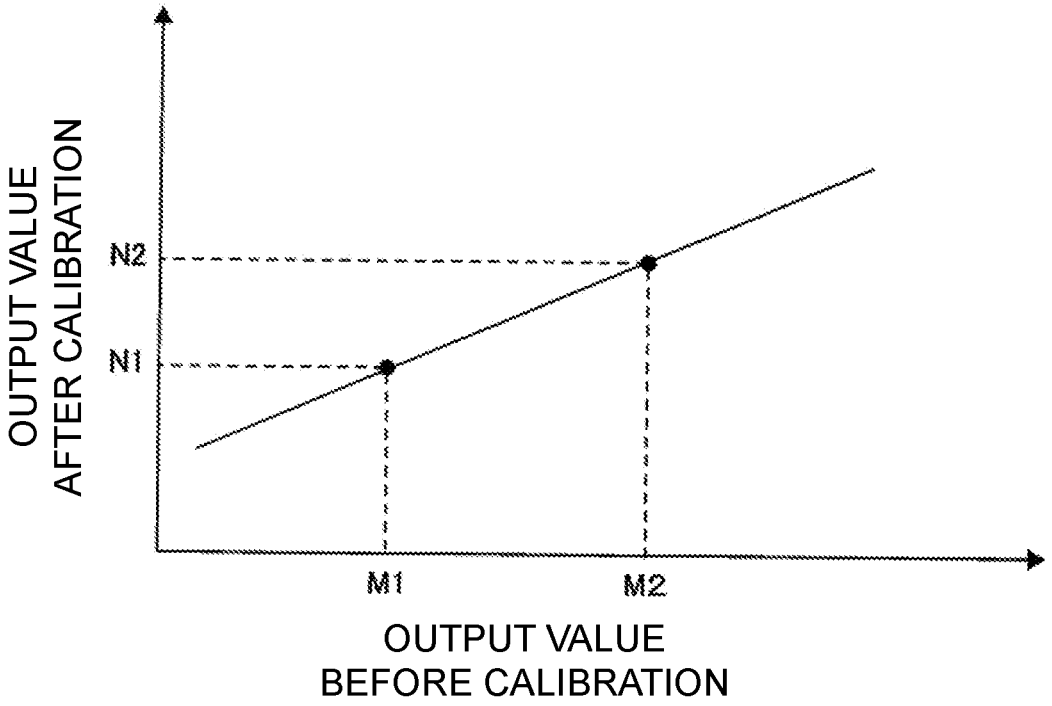
FIG. 6 is a graph showing a relationship between a first output value of the strain measuring instrument when a first force is applied to the support structure, a second output value of the strain measuring instrument when a second force is applied to the support structure, and a first reference value and a second reference value.

FIG. 6 is a graph showing a relationship between the first output value of the strain measuring instrument 20 when the first force is applied to the support structure 15, the second output value of the strain measuring instrument 20 when the second force is applied to the support structure 15, and the first reference value and the second reference value. In FIG. 6, a vertical axis represents the output value of the calibrated strain measuring instrument 20, and a horizontal axis represents the output value of the strain measuring instrument 20 before being calibrated.

As shown in FIG. 6, the first output value M1 of the strain measuring instrument 20 when the first force is applied to the support structure 15 is adjusted to the first reference value N1, and the second output value M2 of the strain measuring instrument 20 when the second force is applied to the support structure 15 is adjusted to the second reference value N2. As described above, the first and second forces applied to the support structure 15 are related to the output values of the strain measuring instrument 20. According to the embodiment, the strain measuring instrument 20 can generate an output value corresponding to the frictional force without being affected by the strength of the support structure 15 and the mounting position of the strain sensor 25.

The calibration of the strain measuring instrument 20 is performed before the polishing of the wafer. However, it is not necessary to perform the calibration before the polishing of all the wafers to be polished.

A method for calibrating the strain measuring instrument 20 is not limited to the embodiment shown in FIG. 5 as long as a predetermined force can be applied to the support structure 15. A method described below is an embodiment of calibrating the strain measuring instrument 20 without using the load measuring instrument 32.

The operation control unit 9 rotates the polishing table 3, also issues a command to the polishing head 1 so that the polishing head 1 presses the wafer W against the polishing pad 2 with a first load, and then causes the polishing head 1 to press the wafer W against the polishing pad 2 with the second load. The second load is different from the first load. Therefore, the frictional force generated between the wafer W and the polishing pad 2 when the first load is applied to the polishing pad 2 is different from that generated between the wafer W and the polishing pad 2 when the second load is applied to the polishing pad 2

When a first load is applied to the polishing pad 2, a first force corresponding to the first load is applied to the support structure 15 through the polishing head 1 and the support structure 15 is distorted. At this time, the strain measuring instrument 20 measures the strain of the support structure 15. Similarly, when the second load is applied to the polishing pad 2, the second force corresponding to the second load is applied to the support structure 15 through the polishing head 1, and the support structure 15 is distorted. At this time, the strain measuring instrument 20 measures the strain of the support structure 15.

Next, as described with reference to FIG. 6, the first output value of the strain measuring instrument 20 when the first force is applied to the support structure 15 is adjusted to the first reference value, and the second output value of the strain measuring instrument 20 when the second force is applied to the support structure 15 is adjusted to the second reference value.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A polishing apparatus which polishes a substrate, comprising:

a rotatable polishing table which supports a polishing pad;

a polishing head which presses the substrate against the polishing pad;

a rotating shaft connected to the polishing head;

a support structure which rotatably supports the rotating shaft;

a strain measuring instrument which measures a strain of the support structure; and an end point detector which determines a polishing end point of the substrate on the basis of a change in the strain, wherein the strain measuring instrument comprises at least one strain sensor fixed to the support structure, and the strain measuring instrument has two measurement modes comprising a low resolution measurement mode which measures the strain at a first resolution, and a high resolution measurement mode which measures the strain at a second resolution higher than the first resolution.

2. The polishing apparatus according to claim 1, wherein:

the low resolution measurement mode is a low gain mode which converts a first range of the strain into a predetermined measurement output range, and the high resolution measurement mode is a high gain mode which converts a second range of the strain narrower than the first range into the measurement output range.

3. The polishing apparatus according to claim 2, wherein the strain measuring instrument comprises a signal converter which converts the first range into the measurement output range and converts the second range into the measurement output range, and the strain sensor is connected to the signal converter.

4. The polishing apparatus according to claim 1, wherein:

the strain measuring instrument comprises a first strain sensor for the low resolution measurement mode and a second strain sensor for the high resolution measurement mode, the first strain sensor is fixed to the support structure, and the second strain sensor is fixed to the support structure.

5. The polishing apparatus according to claim 1, wherein the end point detector is constituted to issue a command to the strain measuring instrument during the polishing of the substrate and to switch the measurement mode of the strain measuring instrument from the low resolution measurement mode to the high resolution measurement mode.

6. A polishing method which polishes a substrate, comprising:

rotating a polishing table which supports a polishing pad;

polishing the substrate by pressing the substrate against the polishing pad with a polishing head connected to a rotating shaft;

measuring a strain of a support structure which rotatably supports the rotating shaft with a strain measuring instrument during polishing of the substrate; and determining a polishing end point of the substrate on the basis of a change in the strain, wherein the strain measuring instrument comprises at least one strain sensor fixed to the support structure, wherein the polishing method further comprises switching a measurement mode of the strain measuring instrument from a low resolution measurement mode to a high resolution measurement mode during the polishing of the substrate, wherein the low resolution measurement mode is a measurement mode which measures the strain at a first resolution, the high resolution measurement mode is a measurement mode which measures the strain at a second resolution higher than the first resolution, and the determining of the polishing end point of the substrate on the basis of the change in the strain is determining of the polishing end point of the substrate on the basis of the change in the strain measured in the high resolution measurement mode.

7. The polishing method according to claim 6, wherein after the strain reaches a peak value during the polishing of the substrate, the measurement mode of the strain measuring instrument is switched from the low resolution measurement mode to the high resolution measurement mode.

8. The polishing method according to claim 6, further comprising adjusting an output value of the strain measuring instrument to a preset value after switching the measurement mode of the strain measuring instrument from the low resolution measurement mode to the high resolution measurement mode.

9. The polishing method according to claim 6, wherein:

the low resolution measurement mode is a low gain mode which converts a first range of the strain into a predetermined measurement output range, and the high resolution measurement mode is a high gain mode which converts a second range of the strain narrower than the first range into the measurement output range.

10. The polishing method according to claim 6, further comprising calibrating the strain measuring instrument before polishing the substrate.

11. The polishing method according to claim 10, wherein the calibrating of the strain measuring instrument comprises:

determining a first output value of the strain measuring instrument when a first force is applied to the support structure;

determining a second output value of the strain measuring instrument when a second force different from the first force is applied to the support structure; and adjusting the first output value and the second output value to a first reference value and a second reference value, respectively.

* * * * *